US008776862B2

(12) United States Patent
Gan et al.

(10) Patent No.: US 8,776,862 B2
(45) Date of Patent: Jul. 15, 2014

(54) CHAMFERED NARROW SIDE COPPER PLATE FOR MOULD WITH FUNNEL-SHAPED CURVED SURFACE

(75) Inventors: Yong Gan, Beijing (CN); Chunzheng Yang, Beijing (CN); Hui Zhang, Beijing (CN); Jianhua Liu, Beijing (CN); Mei Wang, Beijing (CN); Gang Wei, Beijing (CN); Yeming Wu, Beijing (CN); Guozhong Peng, Beijing (CN); Minglin Wang, Beijing (CN); Hongbing Liang, Beijing (CN); Hongbiao Tao, Beijing (CN); Li Wang, Beijing (CN); Changsuo Xi, Beijing (CN); Baosheng Wang, Beijing (CN); Xiuqin Ji, Beijing (CN); Luchun Yuan, Beijing (CN); Yang Zhang, Beijing (CN)

(73) Assignees: Central Iron and Steel Research Institute, Beijing (CN); Zhong Da National Engineering and Research Center of Continuous Casting Technology Co. Ltd., Beijing (CN)

( * ) Notice: Subject to any disclaimer, the term of this patent is extended or adjusted under 35 U.S.C. 154(b) by 0 days.

(21) Appl. No.: 13/462,628

(22) Filed: May 2, 2012

(65) Prior Publication Data

US 2012/0279676 A1 Nov. 8, 2012

(30) Foreign Application Priority Data

May 3, 2011 (CN) ..... 2011 2 0136707 U
Aug. 15, 2011 (CN) ..... 2011 1 0232530

(51) Int. Cl.
*B22D 11/043* (2006.01)

(52) U.S. Cl.
USPC ..... 164/418

(58) Field of Classification Search
CPC ..... B22D 11/04; B22D 11/0406; B22D 11/0408; B22D 11/043
USPC ..... 164/418, 459
See application file for complete search history.

(56) References Cited

U.S. PATENT DOCUMENTS 4,774,995 A * 10/1988 Fastert ..... 164/418
5,460,220 A * 10/1995 Coassin ..... 164/483

(Continued)

FOREIGN PATENT DOCUMENTS

CN ZL02214026.3 4/2003
CN L200720089029.7 10/2008
CN 201871696 U 6/2011
JP 6-91352 A * 4/1994 ..... B22D 11/04

OTHER PUBLICATIONS

Zhigang, "Mould Cross-sectional Dimension & Taper Design", CFHI Technology, vol. 3, 2008, pp. 30-31.

*Primary Examiner* — Kevin P Kerns
(74) *Attorney, Agent, or Firm* — Muncy, Geissler, Olds & Lowe, P.C.

(57) ABSTRACT

A chamfered narrow side copper plate for a mold with a funnel-shaped curved surface has a working face contacting molten steel that includes a middle area and two chamfered areas, which are arranged at two sides. The working face has a funnel-shaped curved surface, which is larger at a top and smaller at a bottom. The chamfered narrow side copper plate for mold with funnel-shaped curved surface can ensure the uniformity of the cooling effect of the chamfered surface and enhance the service life of the narrow side copper plate.

9 Claims, 3 Drawing Sheets

(56) References Cited

Figure 1:
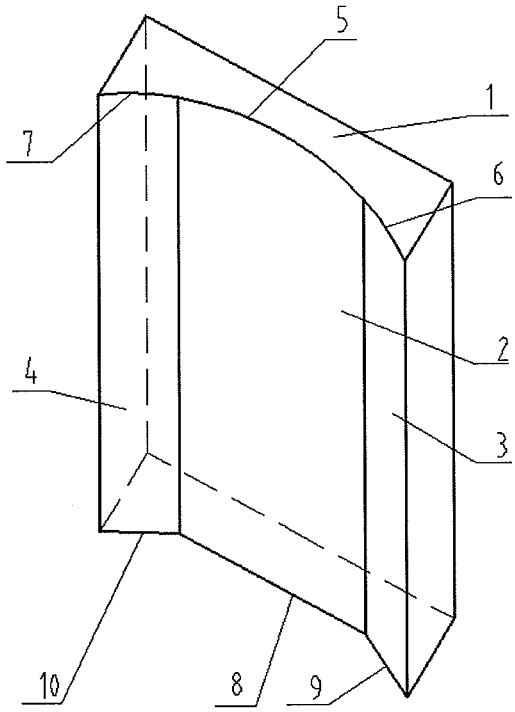

U.S. PATENT DOCUMENTS 6,390,177 B1 * 5/2002 Arvedi et al. ..... 164/418
6,419,005 B1 * 7/2002 Korpela ..... 164/491
6,612,361 B2 * 9/2003 Martellucci ..... 164/418
6,810,943 B2 * 11/2004 Rahmfeld ..... 164/459
6,942,012 B2 * 9/2005 Hauri et al. ..... 164/418
7,198,092 B2 * 4/2007 Hauri et al. ..... 164/418

* cited by examiner

CHAMFERED NARROW SIDE COPPER PLATE FOR MOULD WITH FUNNEL-SHAPED CURVED SURFACE

TECHNICAL FIELD

This invention involves in metal solidification and continuous casting field, especially a chamfered narrow side copper plate for combined mould with funnel-shaped curve surface.

TECHNICAL BACKGROUND

With development of metallurgic technology in the world, modern continuous casting technology makes progress, the varieties of castable steel are increasing and some steel varieties with high alloy, high quality and high cracking susceptibility have been put into production in continuous casting production process in large-scale steel enterprises. Among them, one of the important technical progresses is development and application of chamfered mould technology.

Especially, the development of large-section slab continuous casting technology increases the compression rate of the steel materials and enhances the quality of the steel materials. But expansion of the slab section brings out an adverse influence: slab needs to be bent and straightened in casters so the cracks on angles of the slab may be increased. Specially in recent years, the thickness of the slab for large slab continuous caster has reached and even exceeded 250-450 mm, the thickness of large square and rectangle slabs even exceeds 350-500 mm. Due to uneven cooling of the angle, the stress will definitely cause the increase of the slab corner crack during the bending and straightening process.

Therefore, besides optimization in molten steel equality and second cooling technology, one of the major technical measures taken by metallurgic engineers is adopting chamfered mould technology which changes two existing right angles of the slabs into two obtuse angles (chamfered) so as to eliminate the stress.

The mould technology with chamfered side plates is common in prior arts. Generally the narrow side copper plate for mould with chamfered sides in two forms: one is a separated chamfer which is grasped between the narrow side and wide side of the mould; another is integrated as one which is respectively provided at left and right sides of the narrow surface copper plate for mould.

The separated chamfer between the wide side copper plate and narrow side copper is cooled by means of contact, so the chamfer is provide in small size, generally in 3-10 mm. The chamfer angle is 45° and is equal from top to bottom on any cross section, thus the service life is short.

Chinese utility model ZL 02214026.3 (Publication No.: CN2547438Y, titled "A narrow side copper plate for slab continuous casting mould") provided a kind of the narrow side copper plate for mould with chamfered sides, which chamfer is 45° with size of 6-10 mm. The chamfer angle is 45° on any cross section, but fails to point out the contraction of the narrow side copper plate from top to bottom in the width direction.

Chinese utility model ZL 200720089029.7 (titled "A kind of slab mould") provides a kind of chamfered narrow side copper plate with an arc transition surface for mould. Similarly, this patent fails to point out the change of chamfer of the narrow side copper plate from top to bottom. A conclusion can be drawn through analysis of this patent: the curve shape and size of the chamfer are unchanged from top to bottom.

In practical production, the narrow side of the mould has a taper. A Chinese literature "Mould Cross-sectional Dimension & Taper Design" (source: Cheng Zhigang. CFHI Technology, Volume 3, 2008, p 30-31) analyze the use of the taper of the mould and points out that, the taper of the mould is 0.6%-1.1% generally. In practices, the taper at the narrow side of the mould for traditional large slab continuous caster is within 1-1.5 mm generally. The narrow side copper plates for mould are grasped between the wide side copper plates for mould, so the taper of the narrow side is realized by making the big width on top and small width on bottom. For instance the width on top of the narrow side copper plate is 1 mm longer than the bottom.

Some chamfered narrow side of mould also show a taper which is realized by the big width on top and small width on bottom of the middle plane area of chamfered narrow side copper plate for mould. So far there is no literature or report about the taper of the chamfered narrow side copper plate for mould.

It can be realized from aforementioned cases that all of moulds for traditional continuous casting have the taper with the big width on top and small width on bottom. The technology of the narrow side copper plate for mould with chamfered sides has been used in practices for many years, the chamfered surfaces are plane forms and various different curved surfaces. However, the taper of the bevel of the chamfer has not been considered in existing chamfered mould technologies. Especially when the chamfer is large, e.g. larger than 30 mm, the ignorance of the contraction during solidification will definitely cause the poor cooling effect of the chamfer and cracks occurring on the shell in the mould. That has become an important challenge for application of the narrow side copper plate for mould with large chamfered sides in the production of slab and bloom.

Aiming at the above defects and deficiencies, this invention provides one chamfered narrow side copper plate for mould with funnel-shaped curved surface.

CONTENTS OF INVENTION

The purposes of this invention is to provide a kind of chamfered narrow side copper plate for mould with funnel-shaped curved surface which can effectively compensate the contraction of the chamfered face, enhance the solidification uniformity of the solidified shell on the chamfered face, eliminate the corner cracks of the slabs and prolong the service life of the narrow side copper plate.

For achieve the above purposes, present invention provides following technical solution:

- a kind of chamfered narrow side copper plate 1 for mould with funnel-shaped curved surface, a working face of the narrow side copper plate 1 contacting the molten steel comprises a middle area 2 and two chamfered areas 3, 4 which are arranged at two sides, said work face is a funnel-shaped curve surface which width is longer on top edge and shorter on bottom edge, said funnel-shaped curve surface is selected from one of following combinations:
  - the contour lines of the top edge of the middle area 2 and two chamfered areas 3, 4 which are arranged at two sides are composed of concave curves 5, 6 and 7, and the contour lines of the bottom edge are composed of straight lines 8, 9 and 10; or
  - the contour lines of the top edge of the middle area 2 and two chamfered areas 3, 4 which are arranged at two sides are composed of concave curves 5, 6 and 7, and the contour lines of the bottom edge are composed of concave curves 11, 12 and 13; or the contour line of the top edge of the middle area 2 is the straight line 14, two chamfered areas 3, 4 are inward curves 6, 7, and the contour lines of the bottom edge are composed of straight lines 8, 9, 10.

The curves 5, 6, 7 of the top edge of said narrow side copper plate 1 are 0.3%-2.5% longer than corresponding straight lines 8, 9, 10 or curves 11, 12, 13 of the bottom edge respectively.

The transition curve from top edge to corresponding bottom edge of said narrow surface copper plate 1 is a straight-type smooth transition 18 or a curve-type smooth transition 19 or sectional unsmooth transition 20 on any vertical section.

Said narrow side copper plate is 50-480 mm wide, 700-1200 mm high and 40-100 mm thick in plane area; its width is consistent in the direction of height, or the width of plane area is linearly reducing from top to bottom; the width difference between the top and bottom of the copper plate is 0-4.0 mm.

Angle $\alpha$ which is formed by the working face of chamfered areas 3, 4 and the side surface 17 is 40°-75° on the section at any height of said narrow side copper plate 1.

The height H of the chamfer of said narrow side copper plate 1 is 5-80 mm, and length L of each chamfer is 7%-35% of the width of the cast slab.

Said narrow side copper plate 1 is suitable for straightening mould and arc-shape mould.

Said narrow side copper plate 1 is suitable for casting slab of 110-470 mm thick.

Said narrow side copper plate 1 is made of silver-copper, chromium-zirconium-copper, phosphorus-deoxidized-copper or beryllium-bronze.

Said working face has Ni—Fe coating or Ni—Co coating thereon.

In comparison with prior arts, the advantages of present invention include:

The chamfered narrow side copper plate for mould with funnel-shaped curved surface in present invention can ensure the uniformity of cooling effect on the chamfer and enhance the service life of the narrow side copper plate and chamfer at the side.

EXPLANATION ON ATTACHED DRAWINGS

Figure 2:
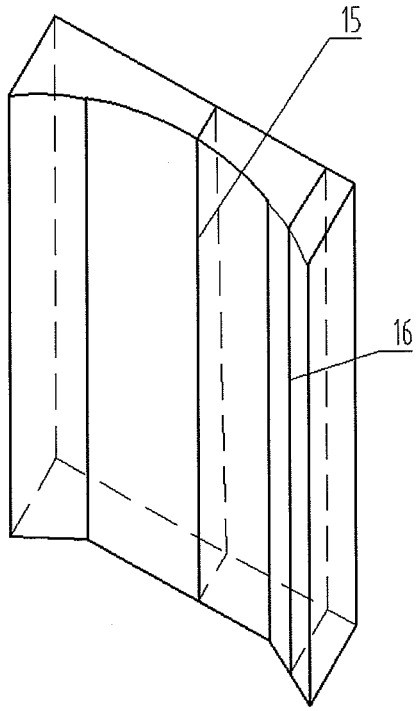
Figures 2A, 2B, 2C:
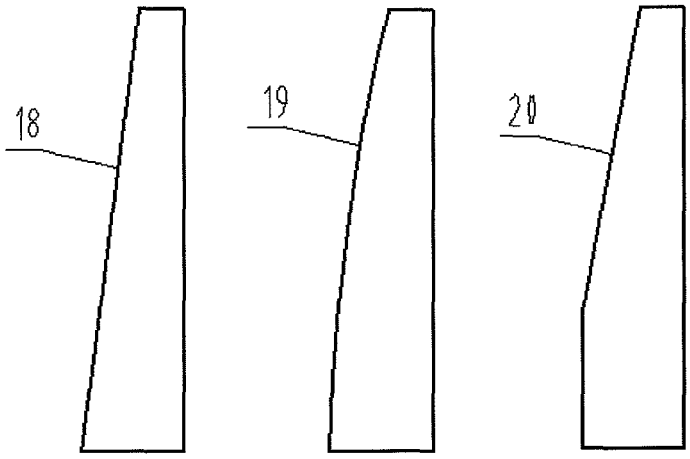
Figure 3:
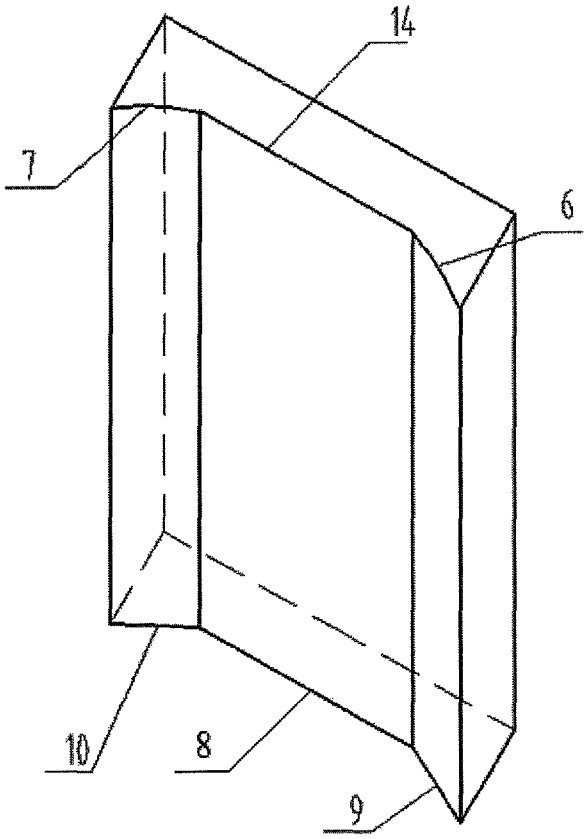
Figure 4:
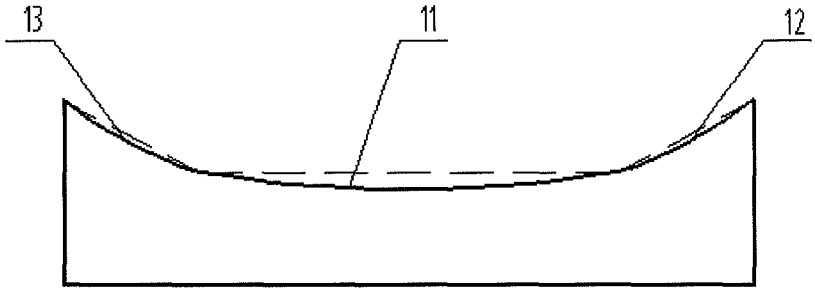
Figure 5:
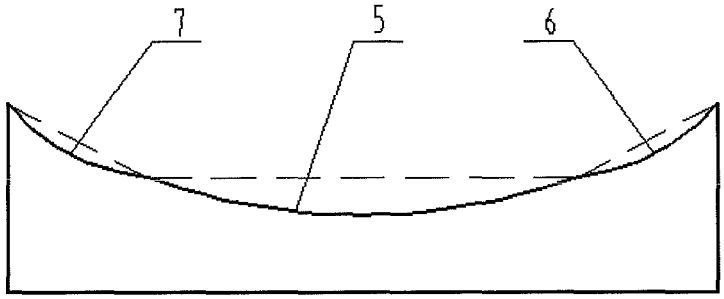
Figure 6:
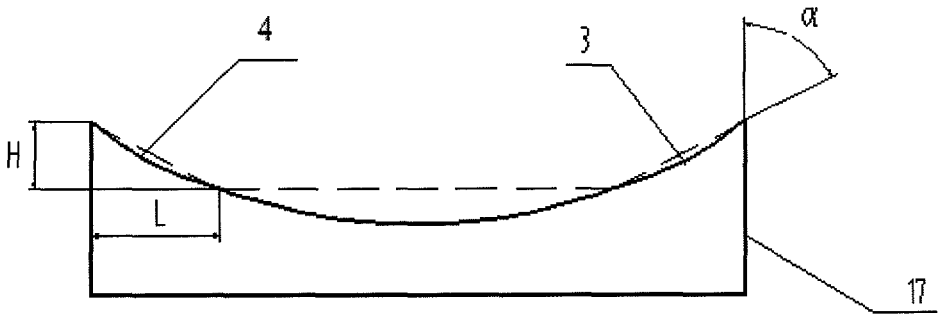

FIG. 1—diagrammatic drawing of structure for a kind of chamfered narrow side copper plate for mould with funnel-shaped curved surface;

FIG. 2—diagrammatic section drawing of curved line transition of the narrow side copper plate from top to bottom;

FIG. 2*a*—diagrammatic section drawing of smooth straight lines transition of the narrow side copper plate from top to bottom;

FIG. 2*b*—diagrammatic section drawing of smooth curved lines transition of the narrow side copper plate from top to bottom;

FIG. 2*c*—diagrammatic section drawing of unsmooth sectional connection line transition of the narrow side copper plate from top to bottom;

FIG. 3—diagrammatic structure drawing of the narrow side copper plate with straight lines at the top and bottom of middle area;

FIG. 4—diagrammatic section drawing of the narrow side copper plate with concave curved at the bottom;

FIG. 5—diagrammatic section drawing of the narrow side copper plate with concave curved at the top;

FIG. 6—diagrammatic drawing of cross section of the narrow side copper plate at any height.

EXPLANATION ON SYMBOLS OF MAIN COMPONENTS

1 chamfered narrow side copper plate for mould in a funnel curved surface shape
2 Middle area on the working face of narrow side copper plate
3 chamfered area at one side of the working face of narrow side copper plate
4 chamfered area at another side of the working face of narrow side copper plate
5 concave curve at the top opening of the middle area on the working face
6 concave curve at the top opening of the chamfered area at one side of the working face
7 concave curve at the top opening of the chamfered area at another side of the working face
8 straight line at the bottom opening of the middle area on the working face
9 straight line at the bottom opening at one side of the working face
10 straight line at the top opening at another side of the working face
11 concave curve at the bottom opening of the middle area on the working face
12 concave curve at the bottom opening of the chamfered area at one side of the working face
13 concave curve at the bottom opening of the chamfered area at another side of the working face
14 straight line at the top opening of the middle area on the working face
15 section line of middle area on the working face
16 section line of chamfered area on the working face
17 side surface of the narrow side copper plate
18 the straight-type smooth transition from top opening to bottom opening
19 the curved-type smooth transition from top opening to bottom opening
20 the connected-type unsmooth transition from top opening to bottom opening

IMPLEMENT MODE OF EMBODIMENTS

Following is further explanation on this invention according to the attached drawings.

As shown in FIG. 1, is the diagrammatic structure drawing chamfered narrow side copper plate for mould with a funnel-shaped curved surface in this invention. Where, the working face of the narrow side copper plate 1 contacting the molten steel which is composed of three parts—a middle area 2 and two chamfered areas at two sides 3, 4. Contour lines of each component part are entirely concave curves 5, 6, 7 at top opening of the narrow surface copper plate and entirely straight lines 8, 9, 10 at the top opening of the narrow side copper plate respectively, and thus the working face of the narrow side copper plate contacting the molten steel is a funnel-shaped curved surface with the long top opening and short bottom opening.

The curves 5, 6, 7 at the top opening of the narrow surface copper plate are 0.3%-2.5% longer than the corresponding straight lines 8, 9, 10 at the bottom opening respectively. One hand, the purpose of this design is to meet the demand of contraction of the shell during solidification when the mould is moving up and down; on the other hand, the purpose is to enhance heat exchange between shell and the copper plate for mould, to strengthen the uniformity of the thickness of the solidified shell. It is especially important for the bevel structure of the large chamfer to meet the demand of the contraction of the solidified shell and enhance the thickness uniformity of the solidified shell because such design can effectively avoid occurrence of the corner crack on slab.

As shown in FIG. 2, the working face of narrow side copper plate 1 is a continuous curved surface, so the transition of each point on the curves 5, 6, 7 at the top opening of narrow side copper plate to corresponding straight lines 8, 9, 10 at the bottom opening may be straight-type smooth transition 18 on any vertical section 15 or 16 as show in FIG. 2*a* or curved-type smooth transition 19 as show in FIG. 2*b* or sectional-type unsmooth transition 20 as shown in FIG. 2*c*.

The copper plate is 50-480 mm wide, 700-1200 mm high and 40-100 mm thick in plane area; its width is consistent along the direction of height, or the width of plane area is linearly reducing from top to bottom, the width difference between the top edge and bottom edge of the copper plate is 0-4.0 mm.

As shown in FIG. 3, whereas the core of the chamfered mould to strengthen cooling uniformity on bevel of the chamfer, therefore, to simplify the processing of the copper plate for mould, the curve at the top opening of the middle area 2 of the narrow surface copper plate 1 may also be straight line 14, i.e. the same as the bottom opening. Meanwhile, the curves 6, 7 at the top opening are still concave curves while the straight line 14 and curves 6, 7 at the top opening are longer 0.3%-2.5% than corresponding straight lines 8, 9, 10 at the bottom opening respectively.

As shown in FIGS. 4 and 5, on the premise that the curves 5, 6, 7 at the top opening of the mould are 0.3%-2.5% longer than the corresponding curves at the bottom opening, the curves at the bottom opening of the working face of narrow side copper plate may be three concave curves 11, 12, 13 while the curves 5, 6, 7 at the top opening are still concave curves. In such case the concave extent of curves at the top opening is bigger than that of curves at the bottom opening.

As shown in FIG. 6, in the respect of chamfer design, in the section of narrow side copper plate at any height, the angle $\alpha$ which is formed by working face of angle part (chamfer) 3 or 4 and side surface 17, is 40°-75°. The height H of chamfer is 5-80 mm, and length L of each chamfer is 7%-35% of the width of the slab.

One curve-shaped chamfered narrow surface copper plate for said combined mould is applicable not only to the straightening mould, but also to arc-shape mould. The moulds are suitable to the slab of 110-470 mm in thick.

This narrow surface copper plate for mould is made of one of material selected from silver-copper, chromium-zirconium-copper, phosphorus-deoxidized-copper or beryllium-bronze. In order to prolong the service life of the copper plate for mould, there is a Ni—Fe plating layer or a Ni—Co plating layer, or no coating on the working face contacting the molten steel.

The invention claimed is:

1. A continuous casting mould having both a narrow side copper plate and a broad side copper plate, wherein the narrow side copper plate is chamfered, and with a funnel-shaped curved surface, a working face of the narrow side copper plate contacting molten steel comprises a middle area and two chamfered areas which are arranged at two sides, wherein said working face is a funnel-shaped curved surface which is larger at a top edge and smaller at a bottom edge, said narrow side copper plate has a top segment comprised of two chamfered concave areas on both sides and a straight edge in between; a bottom segment comprising three segments, wherein two straight edges on both sides and said straight edge extending from said top segment in between both sides.

2. The continuous casting mould as claimed in claim 1, wherein said narrow side copper plate has curves of the top edge of said narrow side copper plate are 0.3%-2.5% longer than corresponding straight lines or curves of the bottom edge respectively.

3. The continuous casting mould as claimed in claim 1, wherein said narrow side copper plate has a transition curve from a top edge to a corresponding bottom edge on said narrow side copper plate is a straight-type smooth transition (18) or a curve-type smooth transition (19) or a sectional unsmooth transition (20) on any vertical section.

4. The continuous casting mould as claimed in claim 1, wherein said narrow side copper plate has an angle $\alpha$ which is formed by the working face of chamfered areas and side surface is 40°-75° on the section at any height of said narrow side copper plate.

5. The continuous casting mould as claimed in claim 1, wherein said narrow side copper plate has a height H of a chamfer on said narrow side copper plate is 5-80 mm, and length L of each chamfer is 7%-35% of the width of a cast slab.

6. The continuous casting mould as claimed in claim 1, wherein said narrow side copper plate is suitable for a straightening mould and an arc-shape mould.

7. The continuous casting mould as claimed in claim 1, wherein said narrow side copper plate is suitable for casting slab of 110-470 mm thick.

8. The continuous casting mould as claimed in claim 1, wherein material of said narrow side copper plate is one of silver-copper, chromium-zirconium-copper, phosphorus-deoxidized-copper or beryllium-bronze.

9. The continuous casting mould as claimed in claim 1, wherein said working face of said narrow side copper plate has a Ni—Fe plating layer or a Ni—Co plating layer.

* * * * *